US009120343B2

(12) United States Patent
Kobayashi

(10) Patent No.: US 9,120,343 B2
(45) Date of Patent: Sep. 1, 2015

(54) RECORDING APPARATUS

(71) Applicant: SEIKO EPSON CORPORATION, Tokyo (JP)

(72) Inventor: Masaki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/211,151

(22) Filed: Mar. 14, 2014

(65) Prior Publication Data

US 2014/0292922 A1 Oct. 2, 2014

(30) Foreign Application Priority Data

Mar. 26, 2013 (JP) ..... 2013-063311

(51) Int. Cl.

| | |
|---|---|
| ***B41J 29/02*** | (2006.01) |
| ***B41J 3/28*** | (2006.01) |
| ***B41J 25/308*** | (2006.01) |
| ***B41J 29/377*** | (2006.01) |

(52) U.S. Cl.

CPC .. *B41J 29/02* (2013.01); *B41J 3/28* (2013.01); *B41J 25/3088* (2013.01); *B41J 29/377* (2013.01)

(58) Field of Classification Search

CPC ..... B41J 29/02

USPC ..... 347/37, 104, 107–109

See application file for complete search history.

(56) References Cited

U.S. PATENT DOCUMENTS

| | | | | |
|---|---|---|---|---|
| 5,650,820 | A * | 7/1997 | Sekine et al. | 347/263 |
| 2010/0289852 | A1* | 11/2010 | Woolfe et al. | 347/37 |
| 2012/0069089 | A1* | 3/2012 | Hendricks et al. | 347/37 |

FOREIGN PATENT DOCUMENTS

| | | |
|---|---|---|
| JP | 2002-002054 | 1/2002 |
| JP | 2012-210781 | 11/2012 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes a supporting stage, a recording unit, frame portions that bridge a space to cross the supporting stage and support the recording unit, and a Y axis movement unit that causes the recording unit and the frame portions to move in relation to the stage in the Y axis direction. The frame portions include a horizontal bridging frame that crosses the supporting stage and supports the recording unit, a pair of side frames that support both sides of the horizontal bridging frame in the X axis direction by end portion sides thereof, and a connecting frame that connects base portion sides of the pair of side frames to one another.

5 Claims, 7 Drawing Sheets

RECORDING APPARATUS

BACKGROUND

1. Technical Field

The present invention relates to a so-called flatbed type recording apparatus, in which a recording unit moves, and performs recording on a recording medium on a stage.

2. Related Art

In the related art, a known example of this type of recording apparatus is provided with a stage portion that supports a recording medium, a recording unit that opposes the stage portion, an X bar (an X axis supporting member) that supports the recording unit to be reciprocally movable in an X axis direction (a main scanning direction), a pair of supporting columns that support both end portions of the X bar, and a Y axis movement mechanism that is connected to each of the supporting columns and causes the recording unit to move in a Y axis direction (a sub-scanning direction) via each of the supporting columns and the X bar (refer to JP-A-2012-210781). In other words, in the recording apparatus, a frame portion (the X bar and each of the supporting columns) that supports the recording unit and is movable in the Y axis direction is formed in a gate shape to straddle the stage portion. Note that, in the disclosure of JP-A-2012-210781, the X axis direction and the Y axis direction are reversed.

However, in this configuration, since the frame portion is formed in a gate shape, there is a problem in that the frame portion is easily deformed. In other words, due to the frame portion being formed in a gate shape, in addition to being susceptible to yawing, the supporting columns deform so as to open to the outside, the lower portions thereof spreading outward; thus, the entire frame portion deforms easily. Therefore, sufficient rigidity may not be obtained for the carried weight. The center of gravity of the frame portion, which moves in the X axis direction, is high due to the gate shape thereof, and there is also a problem in that the frame portion is easily influenced by momentum. Accordingly, the movement accuracy (the movement controllability) of the recording unit is reduced, which brings about a reduction in throughput (the processing ability per unit time) or a reduction in the recording accuracy (the image quality of the recorded image).

SUMMARY

An advantage of some aspects of the invention is that it provides a recording apparatus, in which it is possible to improve the rigidity of the frame portion, and it is possible to lower the center of gravity.

According to an aspect of the invention, there is provided a recording apparatus that includes a stage, which includes a supporting surface that supports a recording medium; a recording unit that performs recording on the recording medium that is supported by the stage; a frame portion, which bridges a first direction so as to cross the stage, and supports the recording unit; and a movement unit, which causes the recording unit and the frame portion to move in relation to the stage in a second direction that is perpendicular to the first direction and is parallel to the supporting surface, in which the frame portion includes a horizontal bridging frame that crosses the stage and supports the recording unit; a first side frame that supports a first side in the first direction of the horizontal bridging frame by end portion sides thereof; a second side frame that supports a second side in the first direction of the horizontal bridging frame by the end portion sides thereof, and a connecting frame that connects a base portion side of the first side frame and a base portion side of the second side frame to one another.

In this configuration, the shape of the frame portion as a whole is rectangular; thus, the frame portion is resistant to yawing, the deformation of the side frames is suppressed, and the frame portion is not easily deformed as a whole. Therefore, the rigidity of the frame portion is improved. By adopting a rectangular shape, the center of gravity of the frame portion is lowered by an amount corresponding to the connecting frame that is provided. Accordingly, it is possible to improve the movement accuracy of the recording unit; thus it is possible to improve the throughput and the recording accuracy.

In this case, it is preferable that the supporting surface of the stage be disposed between the horizontal bridging frame and the connecting frame in a third direction, which is perpendicular to the first direction and the second direction.

In this configuration, the frame portion is disposed to surround the stage; thus, it is possible to dispose the frame portion at a low position in relation to the stage. Accordingly, it is possible to further lower the center of gravity of the frame portion, and it is possible to reduce the height dimension of the entire recording apparatus (the dimension of the direction in which the recording unit and the stage oppose one another). The connecting frame does not interfere with the recording performed by the recording unit due to the connecting frame being disposed on the rear surface side of the stage. Accordingly, it is possible to dispose the recording unit and the connecting frame so as to overlap one another, and it is possible to dispose the connecting frame without restrictions.

It is preferable that the connecting frame include a plurality of rod-shaped frames that bridge a space between the first side frame and the second side frame; and a plate-shaped frame that is fixed to the plurality of rod-shaped frames.

When the connecting frame is configured by only one plate-shaped frame, there is a problem in that it is difficult to maintain a sufficient rigidity while also obtaining a reduction in weight. In other words, when the plate thickness is reduced, sufficient rigidity may not be obtained, and when the plate thickness is increased, the weight increases.

To deal with this problem, according to the configuration described above, by combining the plurality of rod-shaped frames and the plate-shaped frame, it is possible to reduce the weight while maintaining sufficient rigidity. It is also possible to obtain a reduction in the cost of the connecting frame.

Meanwhile, it is preferable that the movement unit include a linear guide mechanism, which causes the recording unit to move in relation to the stage in the second direction, and that the linear guide mechanism include a guide rail, which is fixed to the stage, and extends in the second direction, and a slider, which is fixed on the connecting frame, and moves on the guide rail in a free sliding manner in the second direction.

In this configuration, it is possible to accurately perform the movement of the recording unit relative to the stage due to the fixed side (the guide rail) of the linear guide mechanism being fixed to the stage, and the movable side (the slider) of the linear guide mechanism being fixed to the connecting frame. Accordingly, it is possible to further improve the movement accuracy of the recording unit.

It is preferable that the movement unit include a lead screw mechanism, which causes the recording unit to move in relation to the stage in the second direction, and that the lead screw mechanism include a threaded shaft, which is fixed to the stage, and extends in the second direction, and a nut member, which is disposed on the connecting frame, and screws onto the threaded shaft.

In this configuration, by using the lead screw mechanism (for example, the ball screw mechanism) for the drive mechanism that causes the recording unit to move in the second direction, it is possible to improve the movement accuracy and the rigidity, and it is possible to reduce the costs of the drive mechanism. It is possible to accurately perform the movement of the recording unit relative to the stage due to the fixed side (the threaded shaft) of the lead screw mechanism being fixed to the stage, and the movable side (the nut member) of the lead screw mechanism being fixed to the connecting frame. Accordingly, it is possible to further improve the movement accuracy of the recording unit.

It is preferable that unit movement units, which cause the recording unit to approach and separate in relation to the stage, be disposed on the first side frame and the second side frame, and that the connecting frame connects the unit movement units, which are disposed on the first side frame and the second side frame, to one another.

In this configuration, it is possible to suppress the opening of the side frames, which is caused by play in the unit movement unit, and it is possible to further improve the rigidity of the frame portion due to the unit movement units, which are disposed on each of the side frames, being connected to one another by the connecting frame.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
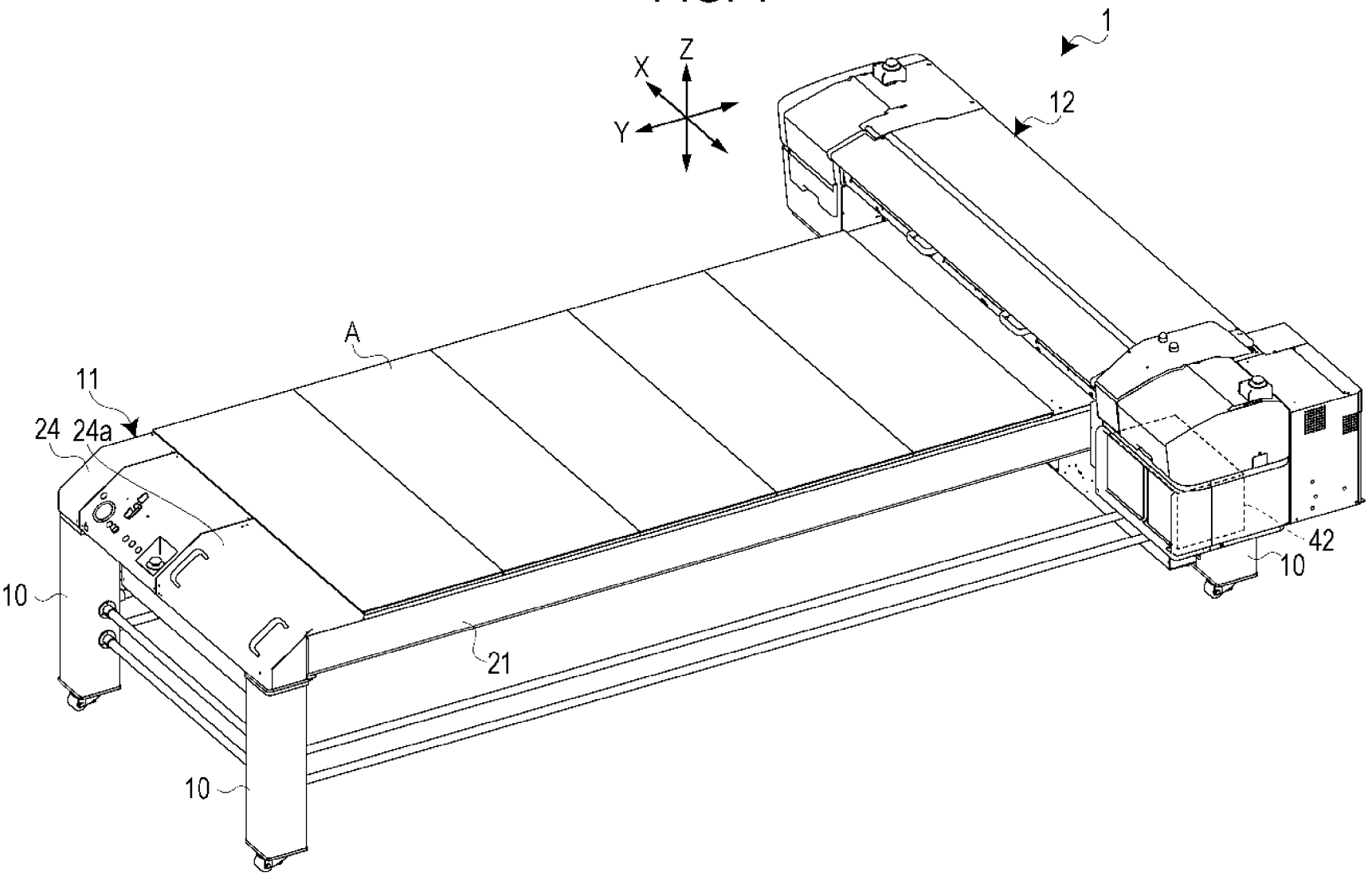
FIG. 1 is an external perspective view showing a recording apparatus according to an embodiment.

Hereinafter, description will be given of the recording apparatus according to an embodiment of the invention with reference to the accompanying drawings. The recording apparatus is a recording apparatus that records a desired image on a recording medium by discharging an ultraviolet curing ink using an ink jet system. Furthermore, the recording apparatus is a so-called flatbed type recording apparatus that performs recording by causing a recording head to move in relation to the recording medium, which is supported by a supporting stage. The recording medium is assumed to be, for example, recording media of different thicknesses such as thick paper, wood, a tile, plastic board, and cardboard. Note that, the X axis (left and right) direction, the Y axis (front and back) direction and the Z axis (up and down) direction are defined as shown in the drawings, and description will be given hereinafter. The Y axis direction and the X axis direction are directions that are parallel to the supporting surface (the setting surface) of the supporting stage. The Y axis direction is perpendicular to the X axis direction, and the Z axis direction is perpendicular to the X axis direction and the Y axis direction. The far side in FIG. 1 will be referred to as a first side in the Y axis direction, and the near side in FIG. 1 will be referred to as a second side in the Y axis direction.

Figure 2A:
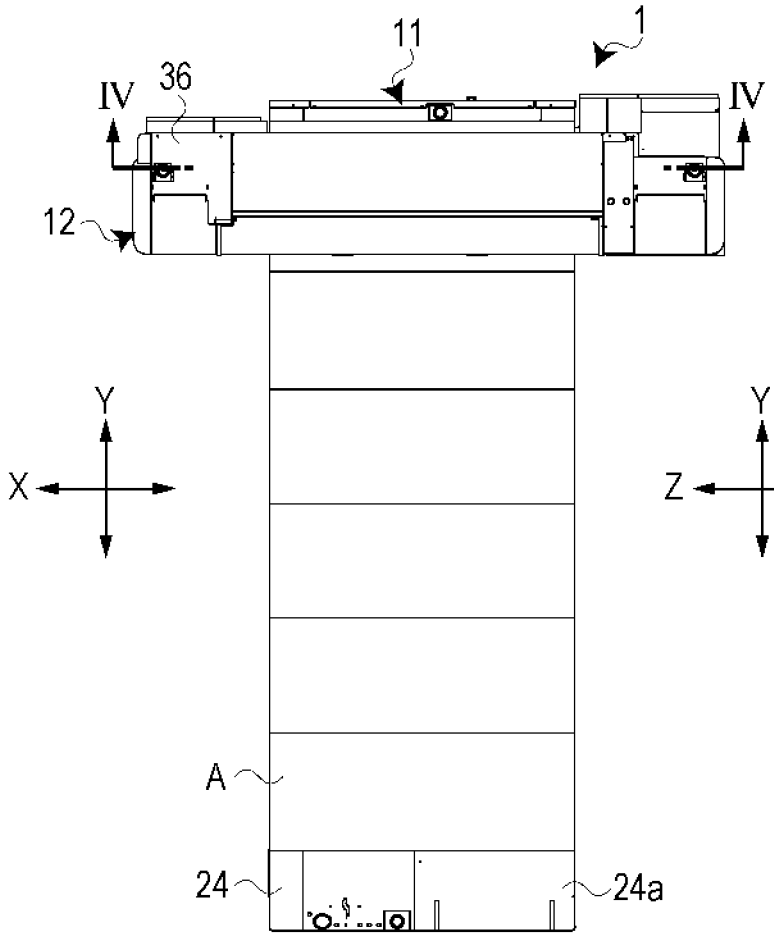
FIGS. 2A to 2C are respectively a plan view, a front view and a side view showing the recording apparatus.
Figure 2C:
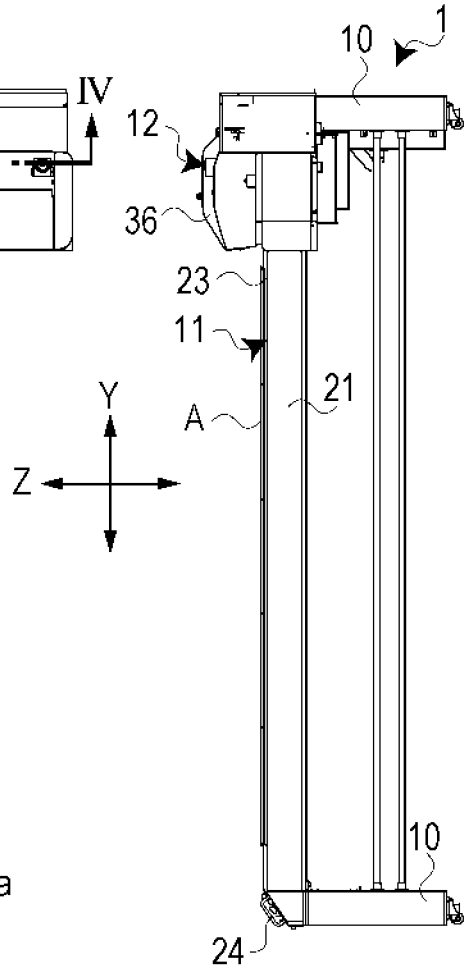
Figure 2B:
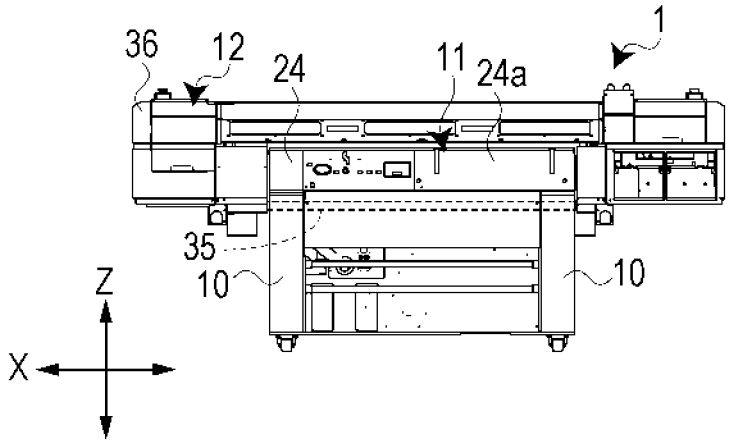
Figure 3:
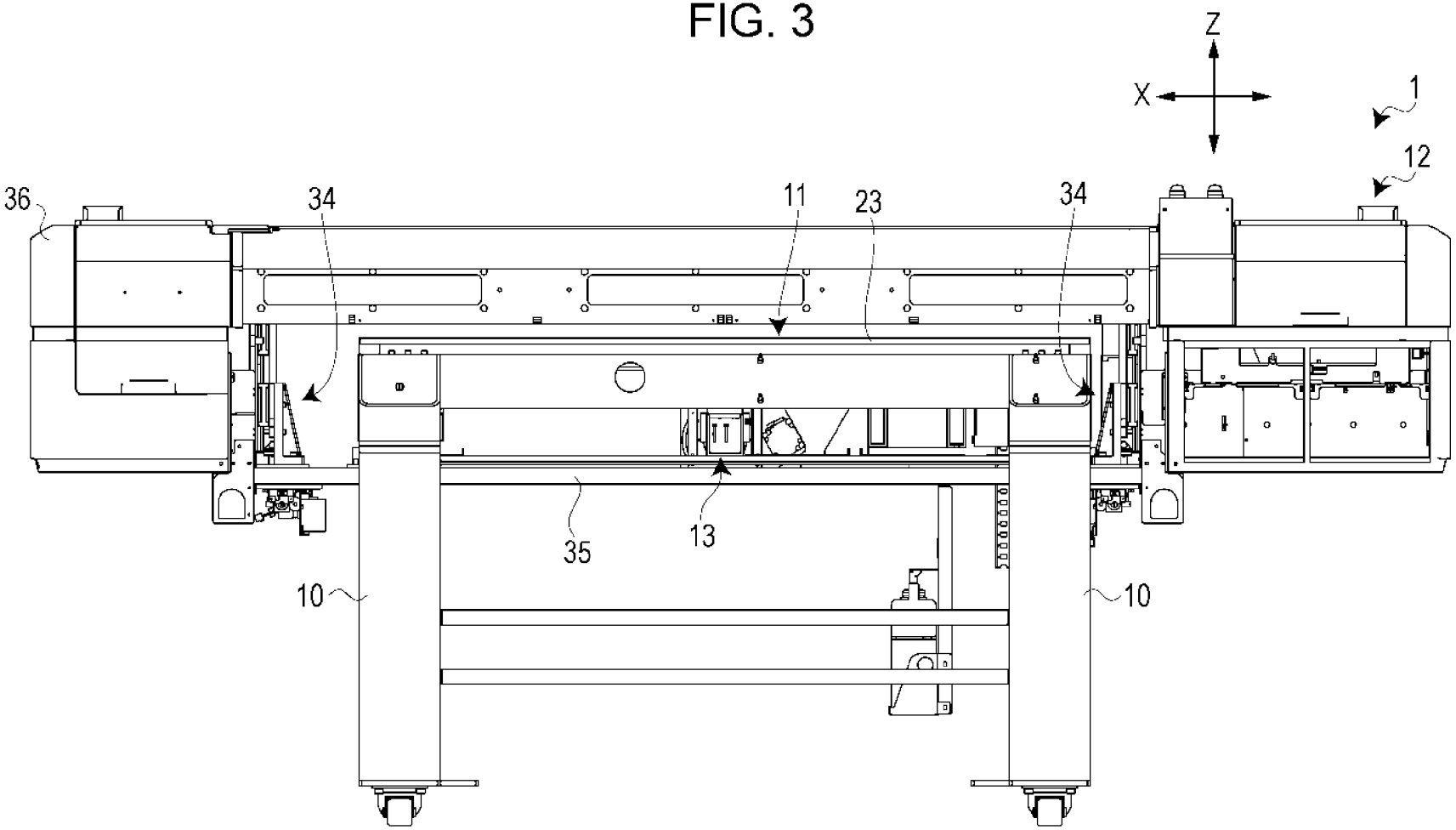
FIG. 3 is a front view showing the recording apparatus with a portion of a supporting stage and a portion of an apparatus cover omitted.

As shown in FIGS. 1 to 3, a recording apparatus 1 is supported by four leg members 10, and is provided with a supporting stage (a stage) 11 that supports a recording medium A, a recording processing unit 12 that includes a recording unit 31 opposing the supported recording medium A, and a Y axis movement unit (a movement unit) 13 that supports the recording processing unit 12 and causes the recording processing unit 12 to move in the Y axis direction (a second direction) in relation to the supporting stage 11. The recording processing unit 12 bridges the X axis direction (a first direction) so as to cross over the supporting stage 11. Meanwhile, the Y axis movement unit 13 is disposed on the rear surface side of the supporting stage (the surface of the opposite side from the recording processing unit 12 side), and supports the recording processing unit 12 in a freely movable manner on the rear surface side of the supporting stage 11 (described hereinafter in detail).

Figure 4:
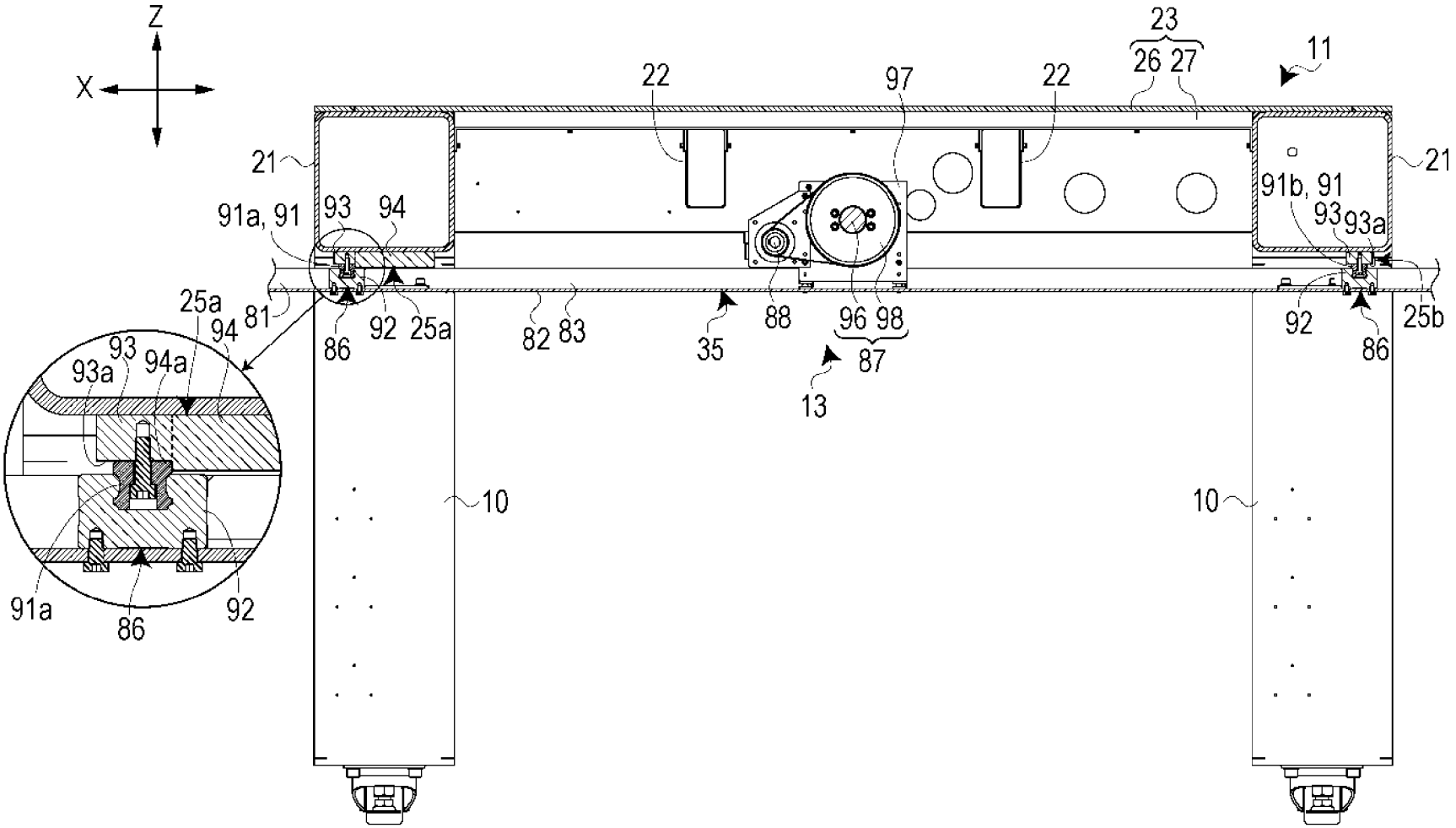
FIG. 4 is a cross-sectional view across the line IV-IV showing the supporting stage and the periphery of a Y axis movement unit.

Next, description will be given of the supporting stage 11 with reference to FIGS. 1, 2A to 2C and 4. FIG. 4 is a cross-sectional view across the line IV-IV of the supporting stage 11 and the periphery of the Y axis movement unit 13 when viewed from the first side in the Y axis direction. As shown in FIGS. 1, 2A to 2C and 4, the supporting stage 11 includes a pair of left and right beam-shaped structural bars 21 that extend in the Y axis direction, a plurality of supporting members 22 that are disposed lengthwise and breadthwise between the pair of structural bars 21, and a suction table 23 that is supported by the pair of structural bars 21 and the plurality of supporting members 22, and on which the recording medium A is set by suction. Each of the end portions of the structural bars 21 are connected to the respective leg members 10 by welding or the like. An operation panel unit 24 is disposed on the end portions of the second side of the supporting stage 11 in the Y axis direction. An opening and closing door 24*a* is provided over a wide portion of the right half portion of the operation panel unit 24. When manually performing maintenance on the recording processing unit 12, the recording processing unit 12 is caused to move to the near side (the second side in the Y axis direction), the opening and closing door 24*a* is opened, and the maintenance of the recording processing unit 12 is performed from the opening and closing door 24*a*.

The suction table 23 includes a table main body 26 that includes a supporting surface that supports the recording medium A, has a large number of suction pores (omitted from the drawings), and a suction chamber 27 provided on the underside of the table main body 26. The suction chamber 27 is connected to a vacuum suction facility (not shown) by a pipe, a duct, or the like. In other words, by driving the vacuum suction facility, the recording medium A that is placed on the table main body 26 is sucked, and the recording medium A is held onto the table main body 26.

The structural bar 21 is configured from a bar, the cross-sectional shape of which is square (a square pipe), and both end portions in the Y axis direction thereof are connected to the respective leg members 10. The upper surface of the structural bar 21 is a table attachment surface, to which the table main body 26 is attached. Rail attachment members 25*a* and 25*b* for attaching guide rails 91 (described hereinafter) are fixed to the respective lower surfaces of the structural bars 21.

Figure 5:
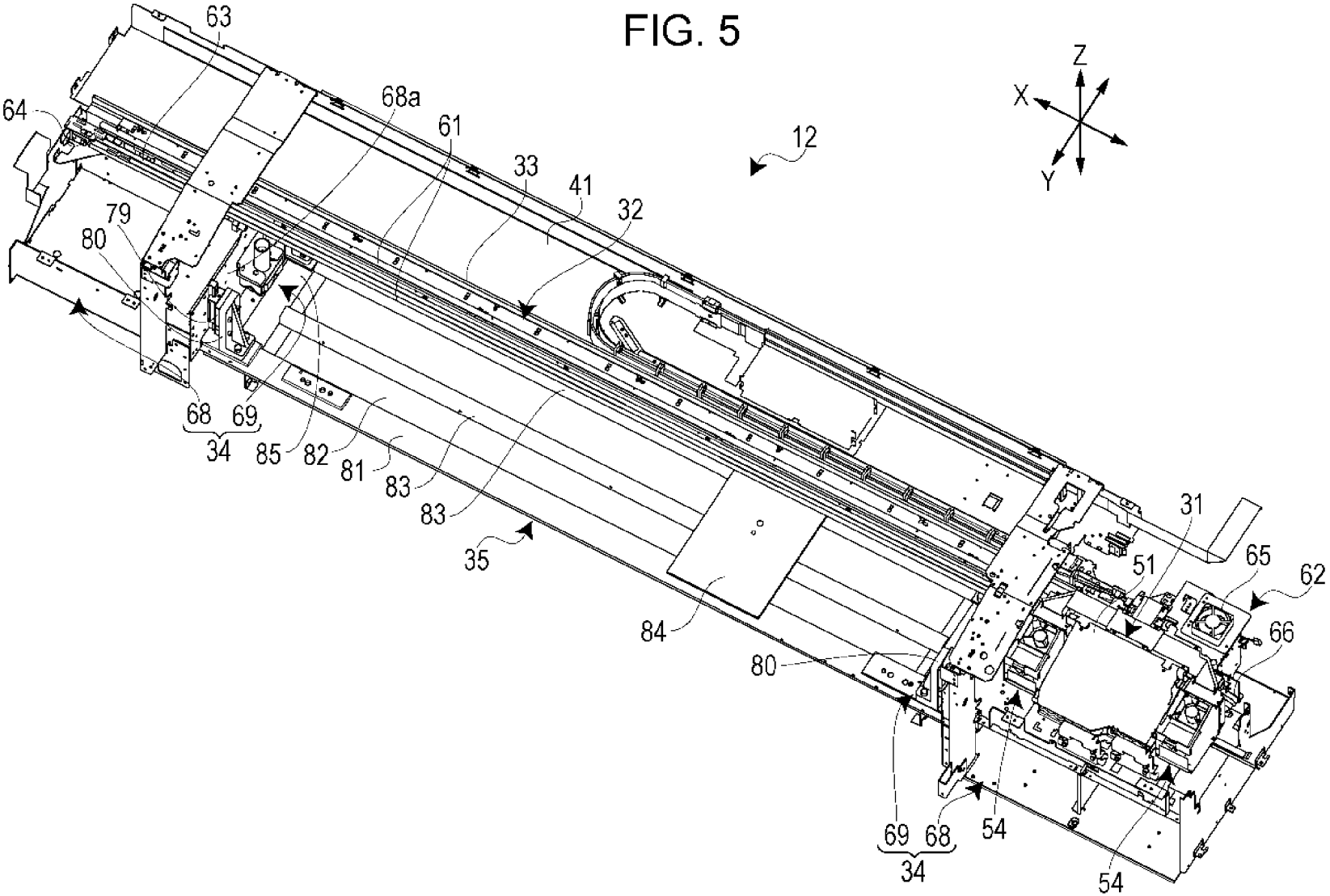
FIG. 5 is a perspective view showing a recording processing unit with the apparatus cover omitted.
Figure 6:
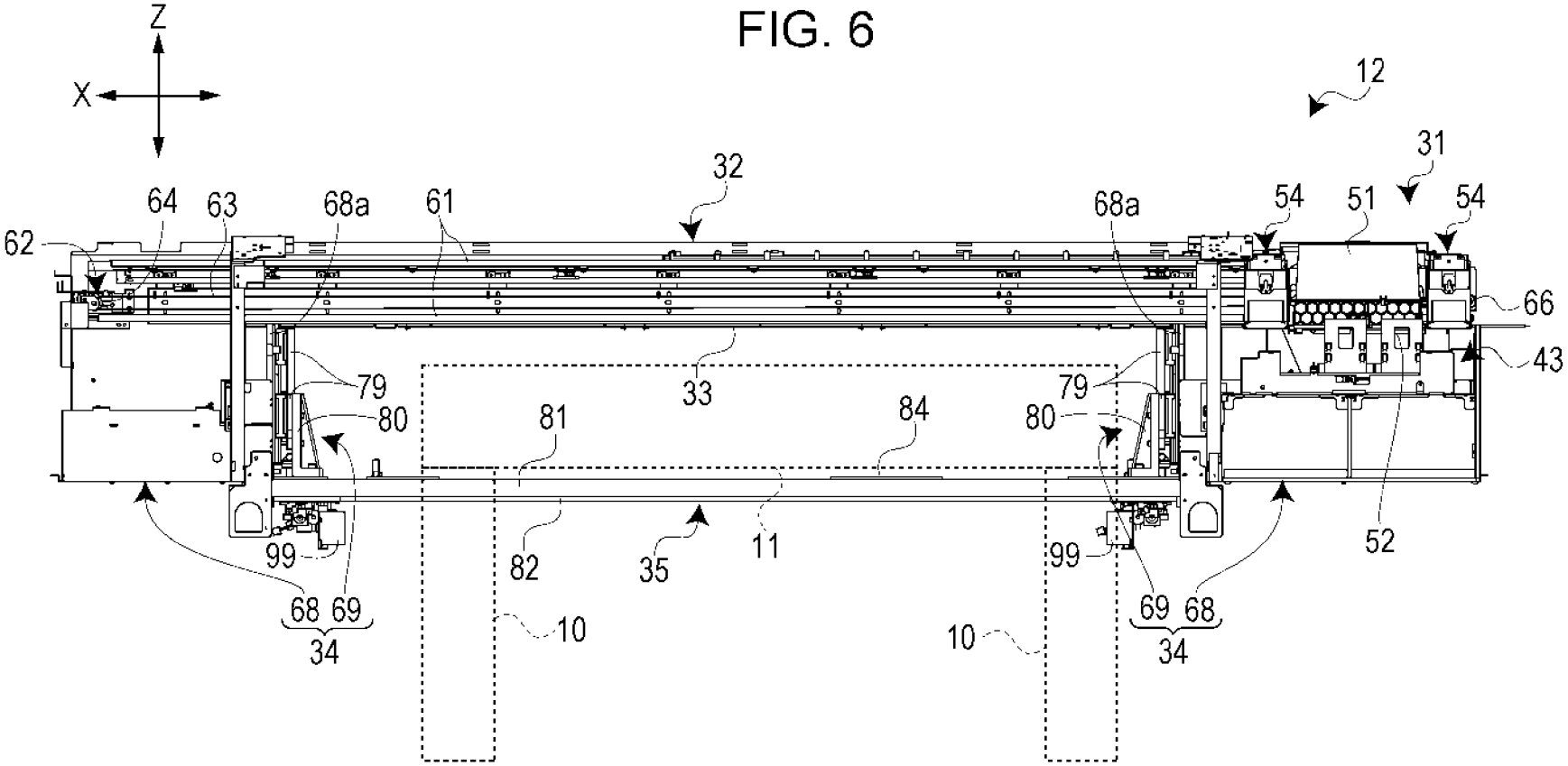
FIG. 6 is a front view showing the recording processing unit with the apparatus cover omitted.

As shown in FIGS. 5 and 6, the recording processing unit 12 is provided with a recording unit 31, an X axis movement unit 32, a horizontal bridging frame 33, a pair of left and right side frames 34, a connecting frame 35, and an apparatus cover (refer to FIG. 1) 36 that covers the above components. The recording unit 31 opposes the supported recording medium A and performs recording on the recording medium A, the X axis movement unit 32 supports the recording unit 31 and causes the recording unit 31 to move in the X axis direction, the horizontal bridging frame 33 supports the X axis movement unit 32, the side frames 34 support the horizontal bridging frame 33 from both sides in the X axis direction, and the connecting frame 35 connects the base portion sides of the pair of side frames 34 to one another. The horizontal bridging frame 33 extends in the X axis direction to cross over the supporting stage 11. In regard to the pair of side frames 34, one of the side frames 34 (the first side frame) supports the right side (the first side in the X axis direction) of the horizontal bridging frame 33, and the other of the side frames 34 (the second side frame) supports the left side (the second side in the X axis direction) of the horizontal bridging frame 33. Each of the side frames 34 extend downward to below the supporting stage 11, and the connecting frame 35 is connected to the lower end portions of both the side frames 34 further below the supporting stage 11 than the table main body 26. Accordingly, the supporting stage 11 is disposed between the horizontal bridging frame 33 and the connecting frame 35.

The supporting stage 11 is bridged by the horizontal bridging frame 33, the pair of side frames 34 and the connecting frame 35; thus configuring a square-shaped (a rectangular-shaped) frame portion that surrounds the supporting stage 11.

The recording processing unit 12 includes a tube holding portion 41, a tank unit (refer to FIG. 1) 42, and a maintenance unit 43. The tube holding portion 41 is disposed on the rear side (the first side) of the horizontal bridging frame 33 in the Y axis direction and holds ink tubes, cables and the like, the tank unit 42 is disposed on the front right and includes ink tanks of various colors, and the maintenance unit 43 is provided in order to maintain and recover the functions of recording heads 52.

The recording unit 31 includes a carriage 51, on which two of the recording heads 52 are mounted, and a pair of ultraviolet radiation units 54, which are provided on both sides in the X axis direction in relation to the carriage 51. Each of the ultraviolet radiation units 54 includes an ultraviolet radiation LED, and causes an ultraviolet curing ink, which is discharged from the recording head 52, to cure (to be fixed) by causing ultraviolet rays to be radiated from the ultraviolet radiation LED.

The recording head 52 is an ink jet head that is driven to discharge by piezoelectric elements (piezo elements), and includes a plurality of nozzle rows (not shown) for each color that extend in the Y axis direction. In other words, the recording head 52 is configured to be capable of discharging plural colors of ultraviolet curing ink. Furthermore, the nozzle surface of the recording head 52 opposes the recording medium A. Note that in this embodiment, a piezo system ink jet head is used; however, the invention it not limited thereto, for example, a thermal system or an electrostatic system ink jet head may also be used. The invention is also not limited to such on-demand types of ink jet head, and a continuous type of ink jet head may also be used.

The X axis movement unit 32 is provided with a pair of upper and lower guide shafts 61, and an X axis drive mechanism 62. The guide shafts 61 are supported by the horizontal bridging frame 33 and support the recording unit 31 to move freely in a reciprocal manner in the X axis direction. The X axis drive mechanism 62 drives the recording unit 31 along the pair of guide shafts 61.

The X axis drive mechanism 62 is provided with a timing belt 63, a drive pulley 66 and a driven pulley 64, a connecting fixing portion (not shown), and a carriage motor 65. The timing belt 63 extends in the X axis direction along the pair of guide shafts 61, and bridges the drive pulley 66 and the driven pulley 64, the connecting fixing portion connects the timing belt 63 with the recording unit 31, and the carriage motor 65 drives the drive pulley 66. In the X axis movement unit 32, the recording unit 31 is caused to move reciprocally in the X axis direction on the pair of guide shafts 61 via the timing belt 63 by causing the carriage motor 65 to rotate forward and backward. The recording process is performed by driving each of the recording heads 52 to discharge together with the reciprocal motion.

Figure 7:
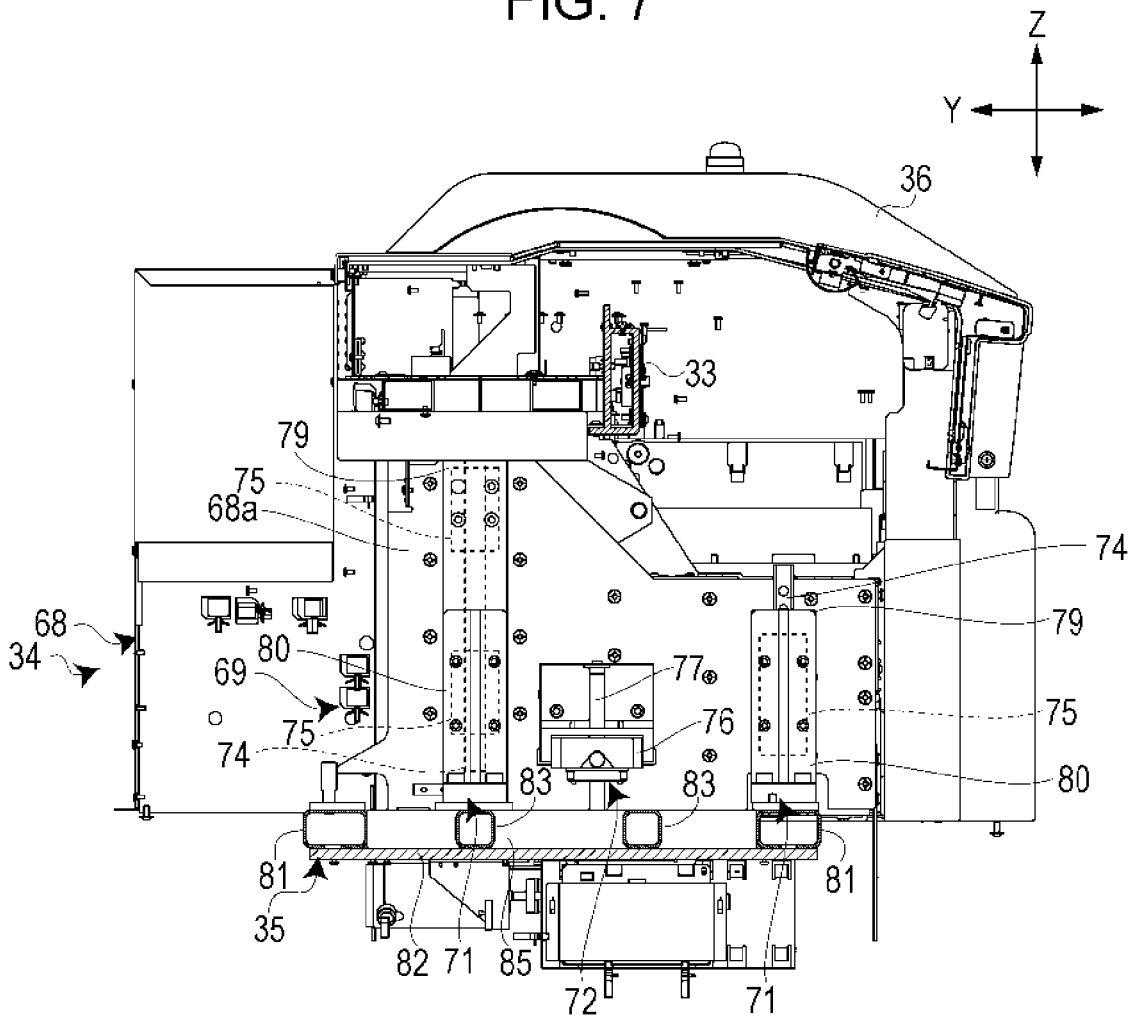
FIG. 7 is an inner side view showing a side frame and the periphery of a raising and lowering movement unit that is retrofitted therein.

Next, description will be given of the side frames 34 with reference to FIGS. 5 to 7. As shown in FIGS. 5 to 7, on each of the side frames 34, there is provided a raising and lowering movement unit (a unit movement unit) 69 that causes the recording unit 31 to move in the vertical direction (the Z axis direction), and causes the recording unit 31 to approach and separate in relation to the supporting stage 11. Specifically, each of the side frames 34 is provided with a box-shaped frame main body 68 that supports the horizontal bridging frame 33, and a raising and lowering movement unit 69 that connects the frame main body 68 and the connecting frame 35 to one another and causes the frame main body 68 to move by being raised or lowered. The recording unit 31 is caused to move by being raised and lowered via the frame main bodies 68, the horizontal bridging frame 33, and the X axis movement unit 32 by causing the frame main bodies 68 to move by being raised and lowered using the raising and lowering movement units 69. Accordingly, the recording unit 31 is caused to approach and separate (gap adjustment) in relation to the supporting stage 11 and the recording medium A that is supported by the supporting stage 11.

The frame main bodies 68 support the horizontal bridging frame 33 by the end portion sides thereof. Furthermore, the frame main bodies 68 include fixing plate portions 68*a*, which fix the movable sides of each of the raising and lowering movement units 69, on the center side (the supporting stage 11 side) of the recording apparatus 1.

Each of the raising and lowering movement units 69 is provided with two raising and lowering guide mechanisms 71, a raising and lowering drive mechanism 72, and a raising and lowering drive motor 99. The raising and lowering guide mechanisms 71 support the frame main body 68 to be raised and lowered freely in relation to the connecting frame 35, the raising and lowering drive mechanism 72 is disposed between the two raising and lowering guide mechanisms 71 and causes the frame main body 68 to move in the vertical direction, and the raising and lowering drive motor 99 drives the raising and lowering drive mechanism 72.

The raising and lowering guide mechanism 71 is configured by the LM guide (registered trademark) mechanism, which is formed from a raising and lowering guide rail 74 that is fixed to the fixing plate portions 68*a*, and a raising and lowering slider 75 that is fixed to the connecting frame 35. Note that the symbols 79 and 80 are a first connecting member and a second connecting member, which connect the raising and lowering slider 75 and the connecting frame 35 to one another.

The raising and lowering drive mechanism 72 is provided with a ball screw mechanism that includes a raising and lowering nut member 76 that is fixed to the fixing plate portion 68*a*, and a raising and lowering threaded shaft 77 that is fixed to the connecting frame 35. Note that, in this embodiment, a configuration is adopted in which the raising and lowering nut member 76 is fixed, the raising and lowering threaded shaft 77 is caused to move rotationally, and the raising and lowering nut member 76 is caused to move in the vertical direction relative to the raising and lowering guide rail 74. However, a configuration may also be adopted in which the raising and lowering threaded shaft 77 is fixed, the raising and lowering nut member 76 is caused to move rotationally, and the raising and lowering nut member 76 is caused to move in the vertical direction relative to the raising and lowering guide rail 74.

As shown in FIGS. 4 to 6, the connecting frame 35 is disposed on the rear surface side of the supporting stage 11, and, is disposed to overlap a movement region of the recording unit 31 and a placement region of the recording medium A in the X and Y directions. Specifically, the connecting frame 35 is provided with a plurality of rod-shaped frames 81, a plate-shaped frame 82, a plurality of vertical frames 85, a plurality of horizontal frames 83, and an attachment plate 84. The rod-shaped frames 81 bridge a space between the base portion sides (between the raising and lowering movement units 69) of both of the side frames 34. The lower surface side of the plate-shaped frame 82 is fixed to a plurality of the rod-shaped frames 81. The vertical frames 85 connect the plurality of rod-shaped frames 81 by both end portions thereof in the X axis direction. The horizontal frames 83 are fixed on the plurality of vertical frames 85 between the plurality of rod-shaped frames 81, and extend parallel to the rod-shaped frames 81. The attachment plate 84 bridges the plurality of rod-shaped frames 81, and a drive motor 88 (described hereinafter) of the Y axis movement unit 13 is attached thereto.

A reinforcement member may also be provided on the connecting frame 35 in order to reinforce the rigidity of the connecting frame 35. For example, a configuration may also be adopted in which the connecting frame 35 further includes a plate-shaped first reinforcement member, a plurality of second reinforcement members, and a plate-shaped third reinforcement member. The first reinforcement member bridges the plurality of rod-shaped frames 81 at the top side thereof. The second reinforcement members are provided to extend in the X axis direction on the first reinforcement member, and the cross-sectional shape of each second reinforcement member forms an inverted square-shaped "U". The third reinforcement member spans across the plurality of second reinforcement members and is fixed to each peak portion thereof. In this case, since the first reinforcement member, the second reinforcement member and the third reinforcement member form a liner and core structure, it is possible to improve the rigidity of the connecting frame 35.

The Y axis movement unit 13 is provided with a pair of linear guide mechanisms 86, a Y axis movement mechanism (a lead screw mechanism) 87, and the drive motor 88. The linear guide mechanisms 86 are positioned on both sides on the left and right of the rear surface side of the supporting stage 11, and cause the recording processing unit 12 to slide in the Y axis direction in relation to the supporting stage 11. The Y axis movement mechanism 87 is positioned on the center of the rear surface side of the supporting stage 11, and causes the recording processing unit 12 to move in the Y axis direction in relation to the supporting stage 11. The drive motor 88 drives the Y axis movement mechanism 87. The Y axis movement mechanism 87 is disposed between the pair of linear guide mechanisms 86 in the X axis direction.

The linear guide mechanisms 86 are configured by the LM guide mechanism. The linear guide mechanisms 86 include the guide rails 91, which are fixed to each of the rail attachment members 25*a* and 25*b* of each of the structural bars 21, and extend in the Y axis direction, and sliders 92, which are fixed to the plate-shaped frame 82 of the connecting frame 35 and move on the guide rails 91 in a free sliding manner. The pair of guide rails 91 of the pair of linear guide mechanisms 86 is configured from a guide rail 91*a* of the reference side, which is used as a reference during attachment, and a guide rail 91*b* of a following side that corresponds to the reference side. The guide rail 91*a* of the reference side is attached to the side at which the distributed load of the recording processing unit 12 is great, that is, the right side (the left side in FIG. 4) where the tank unit 42 is present; whereas, the guide rail 91*b* of the following side is attached to the left side (the right side in FIG. 4).

The pair of rail attachment members 25*a* and 25*b* are configured by the first rail attachment member 25*a* and the second rail attachment member 25*b*. The first rail attachment member 25*a* is fixed to the structural bar 21 of the right side (the left side in FIG. 4), and the guide rail 91*a* of the reference side is attached thereto. Meanwhile, the second rail attachment member 25*b* is fixed to the structural bar 21 of the left side of the recording apparatus 1 (the right side in FIG. 4), and the guide rail 91*b* of the following side is attached thereto. The second rail attachment member 25*b* includes an attachment surface portion 93 that includes a rail attachment surface 93*a* onto which the guide rail 91*b* of the following side is attached.

On the other hand, the first rail attachment member 25*a* is provided with the attachment surface portion 93, which includes the rail attachment surface 93*a* to which the guide rail 91*a* of the reference side is attached, and an attachment reference portion 94, which continues from the attachment surface portion 93 and has a thickness that protrudes downward from the rail attachment surface 93*a*. An attachment reference surface 94*a*, which is the side surface attachment reference of the guide rail 91*a* of the reference side, is formed on the side surface of the rail attachment surface 93*a* side of the attachment reference portion 94. Furthermore, the attachment reference portion 94 strengthens the rigidity of the structural bar 21 due to the thickness and the width of the attachment reference portion 94. Due to this strengthening, the configuration is such that the amount of deflection, caused by the distributed load of the recording processing unit 12, of the pair of structural bars 21 is the same.

The Y axis movement mechanism 87 is configured by a ball screw mechanism. The Y axis movement mechanism 87 includes a threaded shaft 96, which is fixed to the supporting stage 11 and extends in the Y axis direction, and a nut member 98, which is fixed to the plate-shaped frame 82 of the connecting frame 35 via a supporting member 97 to rotate freely and screws onto the threaded shaft 96. The (axis center of the) Y axis movement mechanism 87 is disposed between the surface (a supporting surface) of the supporting stage 11 and the linear guide mechanisms 86 in the vertical direction. In the Y axis movement unit 13, the nut member 98 is caused to move in the Y axis direction relative to the threaded shaft 96 along a thread groove that is formed in the threaded shaft 96 by using the drive motor 88 to drive (rotate) the nut member 98. In this manner, the recording processing unit 12 is caused to move in the Y axis direction along the linear guide mechanisms 86 using the Y axis movement unit 13. In other words, the Y axis movement unit 13 causes the recording unit 31 to move in the Y axis direction via the frame portion (the horizontal bridging frame 33, the side frame 34, and the connecting frame 35). Note that, in this embodiment, a configuration is adopted in which the threaded shaft 96 is fixed and the nut member 98 is driven to rotate; however, a configuration may also be adopted in which the nut member 98 is fixed and the threaded shaft 96 is driven to rotate. By extension, a configuration may also be adopted in which the nut member 98 is caused to move in the Y axis direction relative to the threaded shaft 96 by driving both the nut member 98 and the threaded shaft 96 to rotate.

In this embodiment, the rotating side and the fixed side of the raising and lowering drive mechanism 72 and the Y axis movement mechanism 87 are the reverse of one another with respect to the nut member (the raising and lowering nut member 76 and the nut member 98) and the threaded shaft (the raising and lowering threaded shaft 77 and the threaded shaft 96); however, these may also be the same. In other words, there is conceived to be a pattern in which the raising and lowering threaded shaft 77 and the nut member 98 are the rotating side, and the raising and lowering nut member 76 and the threaded shaft 96 are the fixed side (this embodiment), a pattern in which the raising and lowering nut member 76 and the threaded shaft 96 are the rotating side, and the raising and lowering threaded shaft 77 and the nut member 98 are the fixed side, a pattern in which the raising and lowering threaded shaft 77 and the threaded shaft 96 are the rotating side, and the raising and lowering nut member 76 and the nut member 98 are the fixed side, and a pattern in which the raising and lowering nut member 76 and the nut member 98 are the rotating side, and the raising and lowering threaded shaft 77 and the threaded shaft 96 are the fixed side.

In the recording operation of the recording apparatus 1, the recording unit 31 is caused to be raised or lowered to a predetermined gap position in relation to the recording surface of the recording medium A by the raising and lowering movement units 69; and, subsequently, the recording processing unit 12 is caused to move intermittently from the second side to the first side in the Y axis direction using the Y axis movement unit 13 (line feed). During each pause in the intermittent movement of the recording processing unit 12 in the Y axis direction, the recording unit 31 is caused to move in the X axis direction using the X axis movement unit 32, and the ink is caused to be discharged from the recording head 52 (recording process).

Note that, in this embodiment, when recording execution is commanded using the operation panel unit 24, a test operation is executed before the recording operation. In other words, the user places the recording medium A on the supporting stage 11 in a state in which the recording processing unit 12 is disposed on the first side in the Y axis direction (the waiting position side when setting the recording medium A). Next, the user commands the recording execution using the operation panel unit 24 in a state in which the recording medium A is placed on (held by) the supporting stage 11. When the recording execution is commanded, the recording apparatus 1 causes the recording processing unit 12 to move to the second side in the Y axis direction (the operation panel unit 24 side) using the Y axis movement unit 13. At this time, while the recording unit 31 moves from the first side in the Y axis direction to the second side in the Y axis direction, contact between the recording processing unit 12 and an obstacle, or whether or not an obstacle that the recording unit 31 is likely to make contact with is present is detected using an obstacle detection sensor (not shown) that is provided in the recording processing unit 12. Accordingly, the test operation is executed. The obstacle detection sensor detects whether there is a likelihood that the recording medium A and the recording unit 31 will come into contact with one another, and whether an obstacle that the recording unit 31 is likely to make contact with is present on the recording medium A or on the supporting stage 11.

When an obstacle is detected in this test operation, the recording apparatus 1 causes the movement of the recording processing unit 12 to the second side in the Y axis direction to stop, and notifies the user of the error. On the other hand, when an obstacle is not detected while causing the recording processing unit 12 to move from the first side in the Y axis direction to the second side in the Y axis direction, the recording apparatus 1 determines that there are no obstacles, causes the recording processing unit 12 to move to a predetermined position on the second side in the Y axis direction (the recording start position side) and temporarily stops the movement. After temporarily stopping the movement, the recording apparatus 1 causes the recording processing unit 12 to move from the second side in the Y axis direction (the recording start position side) to the first side in the Y axis direction, and starts the recording operation.

According to the configuration described above, the frame portion (the horizontal bridging frame 33, each of the side frames 34, and the connecting frame 35) as a whole is formed in a rectangular shape; thus, the frame portion is resistant to yawing, the deformation of the side frames 34 is suppressed, and the frame portion is not easily deformed as a whole. Therefore, the rigidity of the frame portion is improved. By adopting a rectangular shape, the center of gravity of the frame portion is lowered by an amount corresponding to the connecting frame 35 that is provided. In particular, it is possible to lower the center of gravity of the frame portion and the recording processing unit 12 in relation to each of the linear guide mechanisms 86. Accordingly, it is possible to improve the movement accuracy of the recording unit 31; thus it is possible to improve the throughput and the recording accuracy.

The connecting frame 35 is disposed such that the frame portion surrounds the supporting stage 11; thus, it is possible to dispose the frame portion at a low position in relation to the supporting stage 11. Accordingly, it is possible to further lower the center of gravity of the frame portion, and it is possible to reduce the height dimension of the entire recording apparatus 1 (the dimension of the direction in which the recording unit 31 and the supporting stage 11 oppose one another). Furthermore, the connecting frame 35 does not interfere with the recording performed by the recording unit 31 due to the connecting frame 35 being disposed on the rear surface side of the supporting stage 11. Accordingly, it is possible to dispose the recording unit 31 and the connecting frame 35 so as to overlap one another, and it is possible to dispose the connecting frame 35 without restrictions.

The connecting frame 35 is configured by combining the pair of rod-shaped frames 81 and the plate-shaped frame 82; thus, it is possible to reduce the weight of the connecting frame 35 while maintaining sufficient rigidity. It is also possible to obtain a reduction in the cost of the connecting frame 35.

It is possible to accurately perform the movement of the recording unit 31 relative to the supporting stage 11 due to the fixed side (the guide rail 91) of the linear guide mechanism 86 being fixed to the supporting stage 11, and the movable side (the slider 92) of the linear guide mechanism 86 being fixed to the connecting frame 35. Accordingly, it is possible to further improve the movement accuracy of the recording unit 31.

The ball screw mechanism is used for the Y axis movement mechanism 87; thus, it is possible to improve the movement accuracy and the rigidity, and it is possible to obtain a reduction in the cost of the Y axis movement mechanism 87. It is possible to accurately perform the movement of the recording unit 31 relative to the supporting stage 11 due to the fixed side (the threaded shaft 96) of the Y axis movement mechanism 87 being fixed to the supporting stage 11, and the movable side (the nut member 98) of the Y axis movement mechanism 87 being fixed to the connecting frame 35. Accordingly, it is possible to further improve the movement accuracy of the recording unit 31.

It is possible to suppress the opening of the side frames 34, which is caused by play in the raising and lowering movement unit 69, and it is possible to further improve the rigidity of the frame portion due to the fixed sides of the raising and lowering movement of the raising and lowering movement unit 69 being connected to one another by the connecting frame 35.

Note that, in this embodiment, a configuration is adopted in which the connecting frame 35 is disposed lower than the entire supporting stage 11; however, the invention is not necessarily limited to a configuration in which the connecting frame 35 is disposed lower than the entire supporting stage 11, as long as the configuration is such that the connecting frame 35 is disposed lower than the surface (the supporting surface) of the supporting stage 11.

By extension, in this embodiment, a configuration is adopted in which the connecting frame 35 is disposed on the rear surface side of the supporting stage 11; however, a configuration may also be adopted in which the connecting frame 35 is disposed higher than the supporting stage 11 (the table main body 26). In this case, it is necessary to dispose the connecting frame 35 to avoid the movement region of the recording unit 31 and the placement region of the recording medium A (for example, on both end portions of the recording processing unit 12 in the Y axis direction).

In this embodiment, the invention is applied to the recording apparatus 1 in which recording is performed by moving the recording unit 31 in the X and Y directions; however, a configuration may also be adopted in which the invention is applied to the recording apparatus 1 in which recording is performed by moving the recording unit 31 that includes a line head in only the Y axis direction (a so-called line printer).

Note that, in this embodiment, the X axis direction is the so-called main scanning direction, and the Y axis direction is the so-called sub-scanning direction.

The entire disclosure of Japanese Patent Application No. 2013-063311, filed Mar. 26, 2013 is expressly incorporated by reference herein.

What is claimed is:

1. A recording apparatus, comprising:

a stage, which includes a supporting surface that supports a recording medium;

a recording unit that performs recording on the recording medium that is supported by the stage;

a frame portion, which bridges a first direction so as to cross the stage, and supports the recording unit; and a movement unit, which causes the recording unit and the frame portion to move in relation to the stage in a second direction that is perpendicular to the first direction and is parallel to the supporting surface, wherein the frame portion includes:

a horizontal bridging frame that crosses the stage and supports the recording unit, a first side frame that supports a first side in the first direction of the horizontal bridging frame by end portion sides thereof, a second side frame that supports a second side in the first direction of the horizontal bridging frame by the end portion sides thereof, and a connecting frame that connects a base portion side of the first side frame and a base portion side of the second side frame to one another, wherein the first and second side frames extend below the supporting surface in a third direction, which is perpendicular to the first direction and the second direction, and the connecting frame is connected to a lower end portion of the first and second side frames, such that the supporting surface of the stage is disposed between the horizontal bridging frame and the connecting frame in the third direction.

2. The recording apparatus according to claim 1, wherein the connecting frame includes a plurality of rod-shaped frames that bridge a space between the first side frame and the second side frame, and a plate-shaped frame that is fixed to the plurality of rod-shaped frames.

3. The recording apparatus according to claim 1, wherein the movement unit includes a linear guide mechanism, which causes the recording unit to move in relation to the stage in the second direction, and wherein the linear guide mechanism includes a guide rail, which is fixed to the stage, and extends in the second direction, and a slider, which is fixed on the connecting frame, and moves on the guide rail in a free sliding manner in the second direction.

4. The recording apparatus according to claim 1, wherein the movement unit includes a lead screw mechanism, which causes the recording unit to move in relation to the stage in the second direction, and wherein the lead screw mechanism includes a threaded shaft, which is fixed to the stage, and extends in the second direction, and a nut member, which is disposed on the connecting frame, and screws onto the threaded shaft.

5. The recording apparatus according to claim 1, wherein unit movement units, which cause the recording unit to approach and separate in relation to the stage, are disposed on the first side frame and the second side frame, and wherein the connecting frame connects the unit movement units, which are disposed on the first side frame and the second side frame, to one another.

* * * * *